US009190769B2

(12) United States Patent
Nonen

(10) Patent No.: US 9,190,769 B2
(45) Date of Patent: Nov. 17, 2015

(54) CABLE CONNECTING APPARATUS, CABLE ASSEMBLY, AND METHOD OF MAKING CABLE ASSEMBLY

(71) Applicant: Hitachi Metals, Ltd., Tokyo (JP)

(72) Inventor: Hideki Nonen, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 26 days.

(21) Appl. No.: 14/093,341

(22) Filed: Nov. 29, 2013

(65) Prior Publication Data

US 2014/0170897 A1 Jun. 19, 2014

(30) Foreign Application Priority Data

Dec. 14, 2012 (JP) ..... 2012-273702

(51) Int. Cl.
*H01R 13/58* (2006.01)
*H01R 12/53* (2011.01)
*H01R 13/6585* (2011.01)

(52) U.S. Cl.
CPC ..... *H01R 13/5829* (2013.01); *H01R 12/53* (2013.01); *H01R 13/6585* (2013.01); *Y10T 29/49174* (2015.01)

(58) Field of Classification Search
CPC ..... H01B 11/00; H01B 13/00; H01R 13/506; H01R 13/508; H01R 13/501; H01R 13/514; H01R 13/582; H01R 13/5825; H01R 13/5829; H01R 13/6272; H01R 13/648; H01R 13/58; H01R 4/48; H01R 4/4818; H01R 4/5804; H01R 12/53
USPC ..... 439/467, 457, 497, 460, 463, 465, 466, 439/607.41, 607.42, 607.47, 579, 98, 63
See application file for complete search history.

(56) References Cited

U.S. PATENT DOCUMENTS

| | | | | |
|---|---|---|---|---|
| 4,448,474 | A * | 5/1984 | Melnychenko | 439/472 |
| 5,713,748 | A * | 2/1998 | Mulvihill | 439/98 |
| 6,380,485 | B1 * | 4/2002 | Beaman et al. | 174/88 R |
| 6,489,563 | B1 * | 12/2002 | Zhao et al. | 174/88 C |
| 2012/0061140 | A1 * | 3/2012 | Nonen et al. | 174/84 |
| 2013/0069670 | A1 * | 3/2013 | Nonen et al. | 324/613 |
| 2013/0161071 | A1 * | 6/2013 | Kodama et al. | 174/250 |

FOREIGN PATENT DOCUMENTS

JP 2012-099434 A 5/2012

* cited by examiner

*Primary Examiner* — Amy Cohen Johnson
*Assistant Examiner* — Oscar C Jimenez
(74) *Attorney, Agent, or Firm* — McGinn IP Law Group, PLLC

(57) ABSTRACT

A cable connecting apparatus includes ground conductors, a first plate member, a second plate member, a separation torsion spring, and engagement members. The ground conductors each include a body that is to be mounted on an outer conductor of a cable, and an arm that is disposed on the body and to be connected to a ground contact of a cable connector. The first plate member and the second plate member clamp the ground conductors in a state in which the ground conductors are arranged side by side. The separation torsion spring and the engagement members are disposed between the first plate member and the second plate member and maintain a constant distance between the plate members.

11 Claims, 9 Drawing Sheets

CABLE CONNECTING APPARATUS, CABLE ASSEMBLY, AND METHOD OF MAKING CABLE ASSEMBLY

The present application is based on Japanese patent application No. 2012-273702 filed on Dec. 14, 2012, the entire contents of which are incorporated herein by reference.

BACKGROUND OF THE INVENTION

1. Field of the Invention

The present invention relates to a cable connecting apparatus, a cable assembly, and a method of making the cable assembly. The cable connecting apparatus is used to collectively connect a plurality of differential signal transmission cables to a cable connector, each of the differential signal transmission cables transmitting differential signals whose phases are shifted by 180 degrees.

2. Description of the Related Art

Some electrical apparatuses, such as servers, rooters, storage devices, for handling high speed digital signals of several Gbit/s or higher, are compliant with a differential interface standard, such as low-voltage differential signaling (LVDS). Between such apparatuses or between circuit boards in such apparatuses, differential signals are transmitted through differential signal transmission cables. By using differential signaling, reduction in the voltage of a system power source is realized. Moreover, differential signaling is resistant to extraneous noise.

A differential signal transmission cable includes a pair of signal line conductors. A positive signal and a negative signal, whose phases are shifted by 180 degrees, are transmitted through the respective signal line conductors. A signal level is represented by the voltage difference between these two signals. For example, an apparatus on the receiving side recognizes that the signal level is "High" when the voltage difference is positive and the signal level is "Low" when the voltage difference is negative.

Japanese Unexamined Patent Application Publication No. 2012-099434 (FIGS. 1 and 2), for example, discloses a technology related to a differential signal transmission cable for transmitting differential signals. In the technology described in Japanese Unexamined Patent Application Publication No. 2012-099434 (FIGS. 1 and 2), a differential signal transmission cable includes a pair of signal line conductors extending parallelly with a predetermined distance therebetween. The signal line conductors are covered with an insulator. In other words, the insulator holds the signal line conductors so that the signal line conductors extend parallelly with a predetermined distance therebetween. The insulator is covered with a sheet-like outer conductor, and the outer conductor is covered with a sheath, which is a protective cover.

By stripping an end portion of the differential signal transmission cable in a stepwise manner, parts of the signal line conductors and a part of the outer conductor are exposed to the outside. A shield connection terminal, which is made of a metal, is connected to an exposed portion of the outer conductor by being crimped. The shield connection terminal includes a metal plate and a solder connection pin that is integrally formed with the metal plate. When the metal plate is crimped, the metal plate becomes plastically deformed so as to follow the shape of the outer conductor. Thus, the outer conductor and the shield connection terminal are electrically connected to each other, and the outer conductor is electrically connected to a ground pad of a circuit board through the shield connection terminal.

SUMMARY OF THE INVENTION

With the technology described in Japanese Unexamined Patent Application Publication No. 2012-099434, in contrast to a technology of directly soldering an outer conductor to a ground pad, a'soldering tip used in a soldering operation (having a temperature of about 350° C.) does not contact the outer conductor. Therefore, it is possible to suppress deformation or melting of the insulator due to the heat of the soldering tip. However, because the shield connection terminal is crimped so as to follow the shape of the outer conductor, an insulator disposed inside the outer conductor may become elastically deformed due to a crimping force. Accordingly, manufacturing problems, such as a change in the distance between signal line conductors inside the insulator, may occur. As a result, electrical characteristics of the signal transmission cable may vary among products. In particular, for a cable assembly, in which a plurality of differential signal transmission cables are connected to a cable connector, variation in the electrical characteristics among products becomes larger.

An object of the present invention is to provide a cable connecting apparatus, a cable assembly, and a method of making a cable assembly, with which it is possible to collectively connect a plurality of differential signal transmission cables to a cable connector in a state in which the electrical characteristics are made stable by suppressing elastic deformation of the differential signal transmission cables.

According to a first aspect of the present invention, a cable connecting apparatus for collectively connecting a plurality of differential signal transmission cables to a cable connector is provided. The plurality of differential signal transmission cables each include a pair of signal line conductors, an insulator surrounding the pair of signal line conductors, and an outer conductor surrounding the insulator. The cable connector includes a pair of signal line contacts corresponding to the pair of signal line conductors and a ground contact corresponding to the outer conductor. The cable connecting apparatus includes a plurality of ground conductors each including a body that is to be mounted on the outer conductor and an arm that is disposed on the body and to be connected to the ground contact; a first clamp member and a second clamp member that clamp the ground conductors in a state in which the ground conductors are arranged side by side; and a distance maintaining mechanism that is disposed between the first clamp member and the second clamp member and that maintains a constant distance between the clamp members.

The cable connecting apparatus may further include a cushion member disposed in at least one of a space between the first clamp member and the ground conductors and a space between the second clamp member and the ground conductors.

The cable connecting apparatus may further include a conducting member disposed between the cushion member and the ground conductors.

In the cable connecting apparatus, the ground conductors may be arranged side by side and fixed to at least one of the clamp members.

The cable connecting apparatus may further include a guide protrusion that is disposed on at least one of the clamp members and that positions the ground conductors.

In the cable connecting apparatus, the distance maintaining mechanism may further include a separation elastic member that is disposed between the clamp members and that generates an elastic force in a direction such that the clamp members are separated from each other, and engagement members that are disposed between the clamp members and that maintain a constant distance between the clamp members by being engaged with each other.

In the cable connecting apparatus, the distance maintaining mechanism may further include an approach elastic member that is disposed between the clamp members and that generates an elastic force in a direction such that the clamp members approach each other, and contact members that are disposed between the clamp members and that maintain a constant distance between the clamp members by being brought into contact with each other.

According a second aspect of the present invention, a cable assembly includes a plurality of differential signal transmission cables, a cable connector to which the plurality of differential signal transmission cables are connected, and a cable connecting apparatus that collectively connects the plurality of differential signal transmission cables to the cable connector. The plurality of differential signal transmission cables each includes a pair of signal line conductors, an insulator surrounding the pair of signal line conductors, and an outer conductor surrounding the insulator. The cable connector includes a connector substrate made of an insulating material, a pair of signal line contacts disposed on the connector substrate and corresponding to the pair of signal line conductors, and a ground contact disposed on the connector substrate and corresponding to the outer conductor. The cable connecting apparatus includes a plurality of ground conductors each including a body that is mounted on the outer conductor and an arm that is disposed on the body and connected to the ground contact, a first clamp member and a second clamp member that clamp the ground conductors in a state in which the ground conductors are arranged side by side, and a distance maintaining mechanism that is disposed between the first clamp member and the second clamp member and that maintains a constant distance between the clamp members.

In the cable assembly, the cable connecting apparatus may further include a cushion member disposed in at least one of a space between the first clamp member and the ground conductors and a space between the second clamp member and the ground conductors.

In the cable assembly, the cable connecting apparatus may further include a conducting member disposed between the cushion member and the ground conductors.

In the cable assembly, the ground conductors, which are arranged side by side, may be fixed to at least one of the clamp members.

In the cable assembly, the cable connecting apparatus may further include a guide protrusion that is disposed on at least one of the clamp members and that positions the ground conductors.

In the cable assembly, the distance maintaining mechanism may include a separation elastic member that is disposed between the clamp members and that generates an elastic force in a direction such that the clamp members are separated from each other, and engagement members that are disposed between the clamp members and that maintain a constant distance between the clamp members by being engaged with each other.

In the cable assembly, the distance maintaining mechanism may include an approach elastic member that is disposed between the clamp members and that generates an elastic force in a direction such that the clamp members approach each other, and contact members that are disposed between the clamp members and that maintain a constant distance between the clamp members by being brought into contact with each other.

According to a third aspect of the present invention, a method of making a cable assembly includes a cable preparation step, a cable connector preparation step, a cable connecting apparatus preparation step, a cable subassembly assembling step, and a connection step. In the cable preparation step, a plurality of differential signal transmission cables are prepared, the differential signal transmission cables each including a pair of signal line conductors, an insulator surrounding the pair of signal line conductors, and an outer conductor surrounding the insulator. In the cable connector preparation step, a cable connector is prepared, the cable connector including a connector substrate made of an insulating material, a pair of signal line contacts disposed on the connector substrate and corresponding to the pair of signal line conductors, and a ground contact disposed on the connector substrate and corresponding to the outer conductor. In the cable connecting apparatus preparation step, a cable connecting apparatus is prepared, the cable connecting apparatus including a plurality of ground conductors each including a body that is to be mounted on the outer conductor and an arm that is disposed on the body and to be connected to the ground contact, a first clamp member and a second clamp member that clamp the ground conductors in a state in which the ground conductors are arranged side by side, and a distance maintaining mechanism that is disposed between the first clamp member and the second clamp member and that maintains a constant distance between the clamp members. In the cable subassembly assembling step, the bodies of the ground conductors are mounted on the outer conductors, the ground conductors, to which the differential signal transmission cables have been attached, side by side between the first clamp member and the second clamp member, are arranged, and the clamp members are caused to clamp the ground conductors while the distance maintaining mechanism is caused to maintain a constant distance between the clamp members. In the connection step, the signal line conductors are disposed on the signal line contacts, the arms are disposed on the ground contacts, the signal line conductors are welded to the signal line contacts, and the arms are welded to the ground contacts.

With the aspects of the present invention, provided are a plurality of ground conductors each including a body that is to be mounted on the outer conductor and an arm that is disposed on the body and to be connected to the ground contact; a first clamp member and a second clamp member that clamp the ground conductors in a state in which the ground conductors are arranged side by side; and a distance maintaining mechanism that is disposed between the first clamp member and the second clamp member and that maintains a constant distance between the clamp members. Thus, in contrast to existing technologies, it is not necessary to crimp the shield connection terminal so as to follow the shape of the outer conductor. Therefore, elastic deformation of the differential signal transmission cables can be suppressed and thereby the electrical characteristics can be stabilized. Moreover, because the clamp members collectively clamp the plurality of ground conductors with the same force, that is, under the same conditions, the electrical characteristics of the cable assembly can be stabilized. Furthermore, the cable connecting apparatus holds the differential signal transmission cables while the cable assembly is being assembled. Therefore, the differential signal transmission cables can be easily connected to the cable connector.

DESCRIPTION OF THE PREFERRED EMBODIMENTS

Hereinafter, a first embodiment of the present invention will be described in detail with reference to the drawings.

Figure 1:
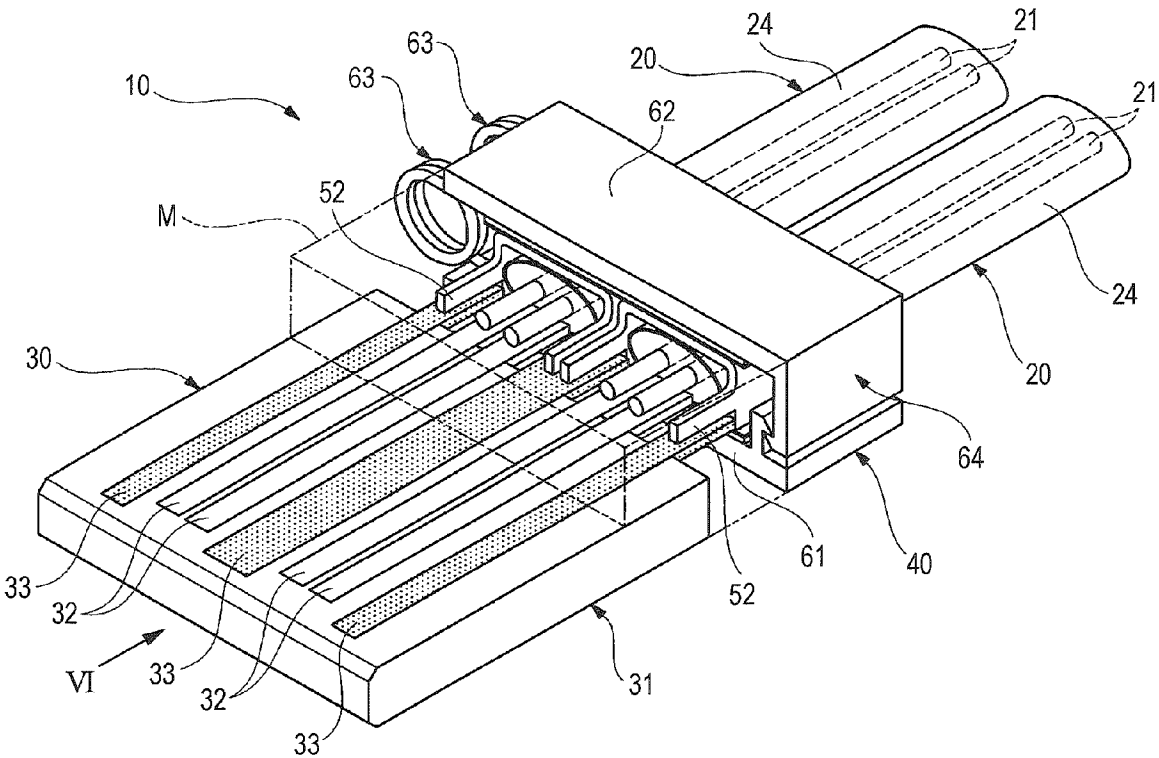
FIG. 1 is a perspective view of a cable assembly including a cable connecting apparatus according to a first embodiment.
Figure 2:
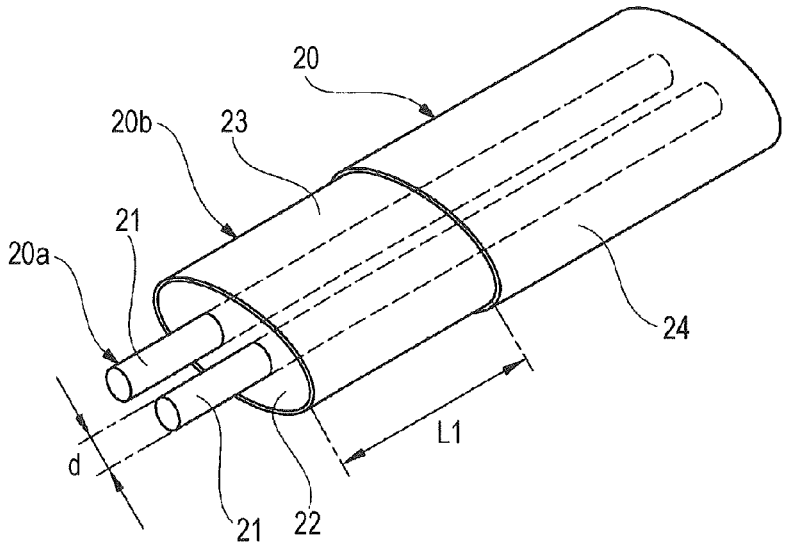
FIG. 2 is a perspective view of a differential signal transmission cable.
Figure 3:
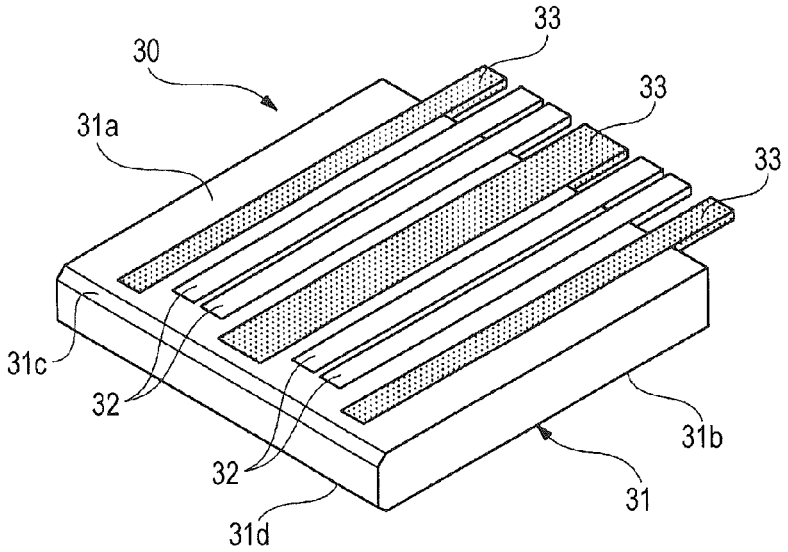
FIG. 3 is a perspective view of a cable connector.
Figure 4:
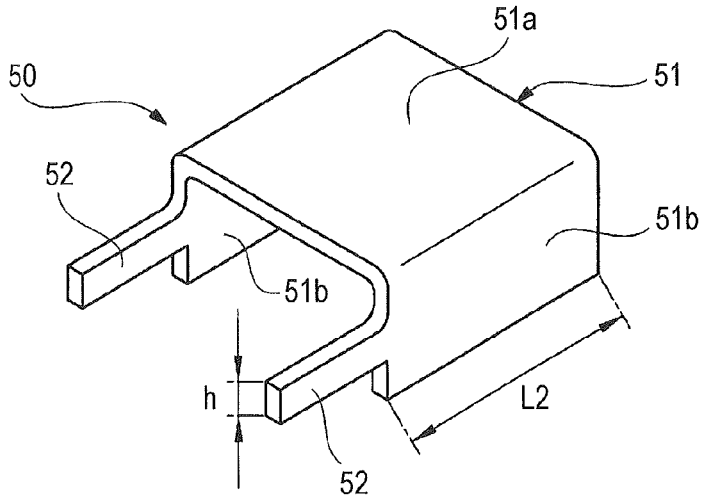
FIG. 4 is a perspective view of a ground conductor of the cable connecting apparatus.
Figure 5:
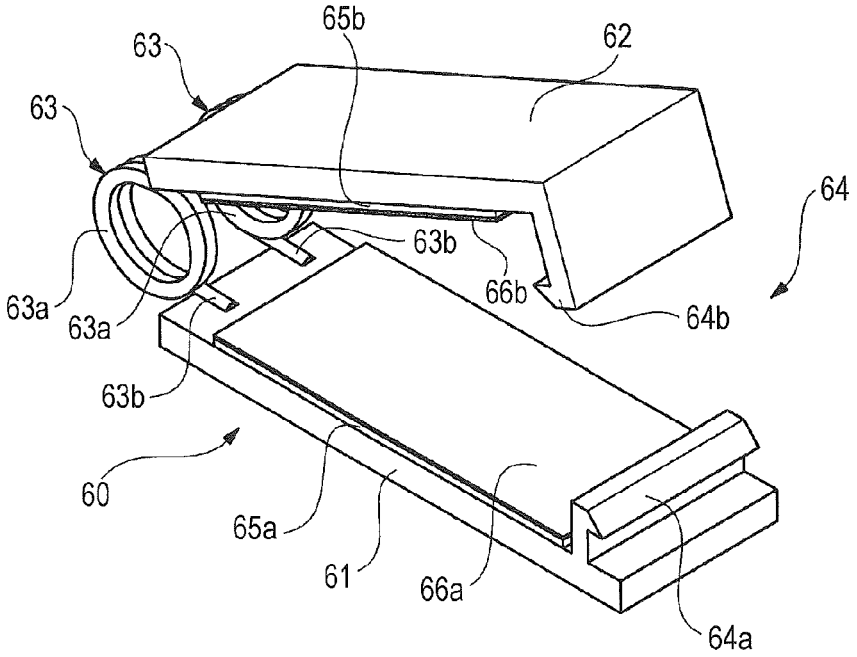
FIG. 5 is a perspective view of a clamp mechanism of the cable connecting apparatus.
Figure 6:
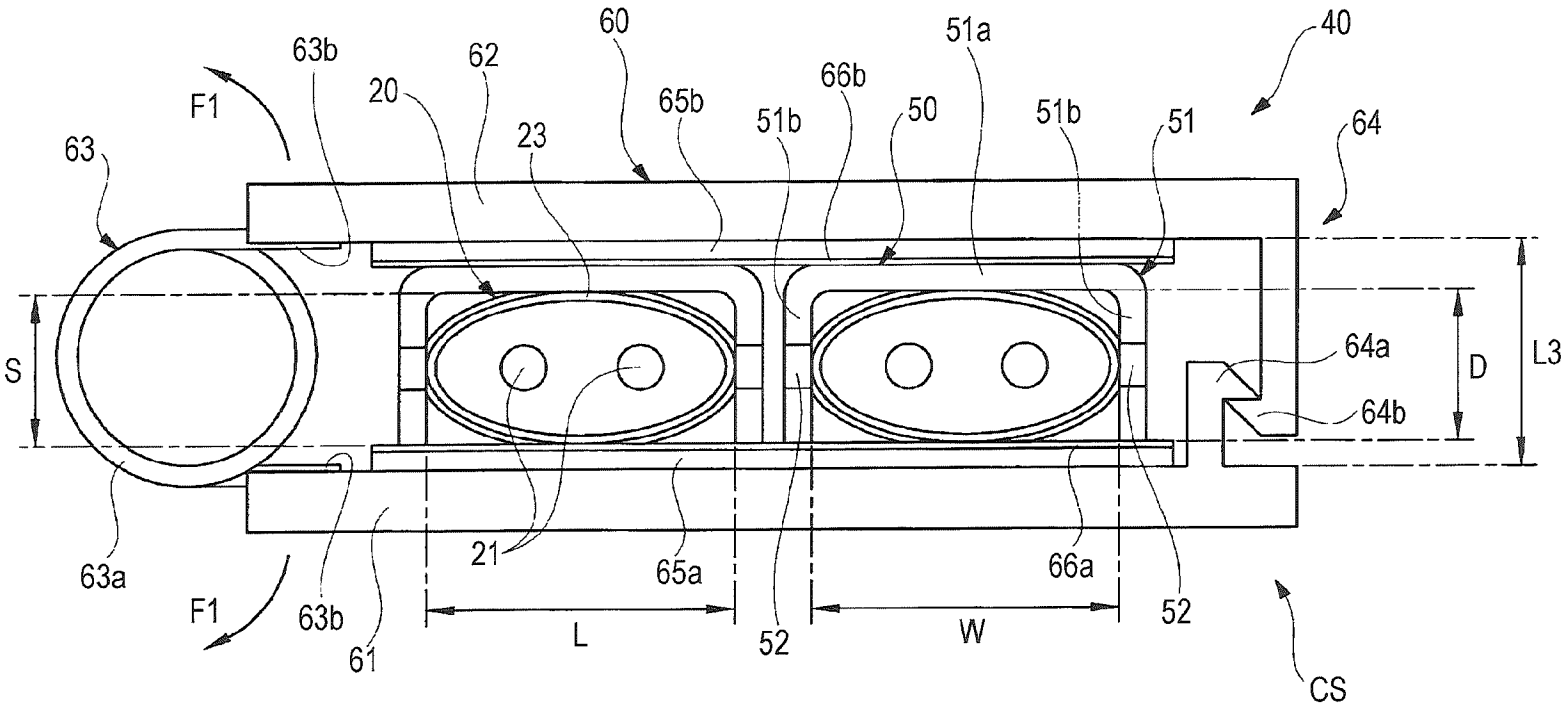
FIG. 6 illustrates a subassembly of the cable assembly from which the cable connector is removed, which is seen in the direction of arrow VI in FIG. 1.

FIG. 1 is a perspective view of a cable assembly including a cable connecting apparatus according to the first embodiment. FIG. 2 is a perspective view of a differential signal transmission cable. FIG. 3 is a perspective view of a cable connector. FIG. 4 is a perspective view of a ground conductor of the cable connecting apparatus. FIG. 5 is a perspective view of a clamp mechanism of the cable connecting apparatus. FIG. 6 illustrates a subassembly of the cable assembly from which the cable connector is removed, which is seen in the direction of arrow VI in FIG. 1.

As illustrated in FIG. 1, a cable assembly 10 includes two differential signal transmission cables 20, a cable connector 30 to which the differential signal transmission cables 20 are connected, and a cable connecting apparatus 40 that collectively connects the differential signal transmission cables 20 to the cable connector 30. Two-dot chain lines in FIG. 1 represent a mold resin portion M, which is filled an insulating thermosetting epoxy resin that has been solidified. The mold resin portion M protects connection portions through which the differential signal transmission cables 20 and the cable connector 30 are connected to each other. Note that the mold resin portion M may be omitted depending on the environment in which the cable assembly 10 is used.

As illustrated in FIG. 2, the differential signal transmission cable 20 includes a pair of signal line conductors 21. A positive signal of a differential signal is transmitted through one of the signal line conductors 21. A negative signal of the differential signal is transmitted through the other signal line conductor 21. The signal line conductors 21 are, for example, made from tinned annealed copper wires. The signal line conductors 21 are covered with insulators 22.

The insulator 22 is made from, for example, foamed polyethylene so that the differential signal transmission cable 20 can have flexibility. The insulator 22 has a substantially elliptical cross-sectional shape. The insulator 22 holds the signal line conductors 21 in such a way that the signal line conductors 21 extend with a predetermined distance therebetween. The insulator 22 surrounds the signal line conductor 21 in such a way that the insulator 22 has substantially the same thickness around the respective signal line conductors 21.

The cross-sectional shape of the insulator 22 is not limited to a substantially elliptical shape shown in FIG. 2. Alternatively, for example, each of the signal line conductors 21 may be covered with an insulator having a substantially circular cross-sectional shape. Further alternatively, the cross-sectional shape of the insulator 22 may be a shape composed of a pair of parallel line segments having the same length and a pair of semicircles, that is, a shape substantially the same as that of an athletic track of a stadium.

An outer conductor 23, for suppressing influence of extraneous noise, surrounds the insulator 22. The outer conductor 23 is made from, for example, a copper foil. The outer conductor 23 covers most part of the insulator 22 excluding ends of the insulator 22 in the longitudinal direction. Alternatively, the outer conductor 23 may be made from a metal foil other than a copper foil. Further alternatively, the outer conductor 23 may be a braided sheet made from thin metal wires, such as annealed copper wires.

A sheath 24, which is a protective cover for protecting the differential signal transmission cable 20, surrounds the outer conductor 23. The sheath 24 covers most part of the outer conductor 23 excluding ends of the outer conductor 23 in the longitudinal direction. The sheath 24 is made of, for example, a heat-resistant polyvinyl chloride. The differential signal transmission cable 20 does not include a drain wire.

As illustrated in FIG. 2, an end of the differential signal transmission cable 20 is stripped in a stepwise manner in the longitudinal direction. As a result, a signal line conductor exposed portion 20*a*, at which the signal line conductors 21 are exposed to the outside, and an outer conductor exposed portion 20*b*, at which of the outer conductor 23 is exposed to the outside, are formed. The signal line conductor exposed portion 20*a* and the outer conductor exposed portion 20*b* are arranged in this order from the end of the differential signal transmission cable 20. Each of the signal line conductors 21 has a diameter d, and each of the outer conductor exposed portions 20*b* has a length L1.

As illustrated in FIG. 3, the cable connector 30 includes a connector substrate 31, four signal line contacts 32, and three ground contacts 33. The connector substrate 31 is inserted into a slot that is formed, for example, in a backplane product (not shown). Parts of the signal line contacts 32 and the ground contacts 33 in the longitudinal direction, which respectively have lengths that are substantially ⅕ of the entire lengths of the contacts 32 and 33, protrude from an edge of the connector substrate 31. Two differential signal transmission cables 20 are respectively electrically connected to the protruding portions (the right side portions in FIG. 3) of the signal line contacts 32 (see FIG. 1). One of the ground contacts 33 that is disposed in a central part of the connector substrate 31 has a width larger than those of other ground contacts 33 and serves as a common component for both of the differential signal transmission cables 20.

The connector substrate 31 is a plate-like member made of an insulating material, such as an epoxy resin. The connector substrate 31 has a front surface 31*a* and a back surface 31*b*. At an end portion of the connector substrate 31 in an insertion direction in which the connector substrate 31 is inserted into a slot, a pair of chamfered surfaces 31*c* and 31*d* are formed so as to correspond to the front surface 31*a* and the back surface 31*b*. Due to the presence of the chamfered surfaces 31*c* and 31*d*, the end portion of the connector substrate 31 in the insertion direction is tapered, so that the connector substrate 31 can be guided into a socket.

Each of the signal line contacts 32 and the ground contacts 33 is a narrow plate made by press-forming a metal plate made of a high conductivity brass or the like. The signal line contacts 32 and the ground contacts 33 are formed so as to be embedded in parts of the connector substrate 31 near the front surface 31*a* side in the thickness direction by insert molding. In order to prevent a short circuit, the contacts 32 and 33 are disposed with predetermined distances therebetween. Parts of the signal line contact 32 and the ground contact 33 extending in the thickness direction are exposed to the outside from the front surface 31*a*.

The signal line contacts 32 correspond to the signal line conductors 21, and the ground contacts 33 correspond to the outer conductors 23. In FIGS. 1 and 3, the ground contacts 33 are shaded in order to make the ground contacts 33 easily distinguishable from the signal line contacts 32.

The cable connecting apparatus 40 includes ground conductors 50, one of which is illustrated in FIG. 4, and a clamp mechanism 60 illustrated in FIG. 5.

As illustrated in FIG. 4, the ground conductor 50 includes a body 51 having a substantially U-shaped cross section. The ground conductor 50 is made by press-forming a metal plate made of a high conductivity brass or the like. The body 51 has a top wall 51*a* and a pair of side walls 51*b* facing each other. The outer conductor 23 (see FIG. 6) of the differential signal transmission cable 20 is to be attached to the inside of the body 51. The body 51 has a length L2 that is substantially the same as the length L1 (see FIG. 2) of the outer conductor exposed portion 20*b* (L2≈L1). Thus, the body 51 covers the outer conductor 23 from one side of the outer conductor 23 (the upper side in FIG. 6).

As illustrated in FIG. 6, the distance between the side walls 51*b*, that is, the inner width of the body 51 is W. The width W is slightly smaller than the length L of the major axis of the cross-sectional shape of the outer conductor 23 (W<L). Thus, when the outer conductor 23 is fitted into the body 51, the outer conductor 23 can be electrically connected to the ground conductor 50 securely. The difference between the length L and the width W is set at a value such that the outer conductor 23 does not become deformed considerably and the ground conductor 50 does not come off the outer conductor 23 under its own weight when the ground conductor 50 is mounted on the outer conductor 23. With such a structure, the electrical characteristics of the differential signal transmission cable 20 are not negatively affected.

The inner depth D of the body 51 is substantially the same as the length S of the minor axis of the cross-sectional shape of the outer conductor 23 (D≈S). Thus, as illustrated in FIG. 6, the clamp mechanism 60 clamps the outer conductors 23 and the ground conductors 50 in a state in which the outer conductors 23 are attached to the ground conductors 50.

As illustrated in FIG. 4, an arm 52 is integrally formed with each of the side walls 51*b* so as to extend in the longitudinal direction of the ground conductor 50. In a state in which the outer conductors 23 are attached to the ground conductors 50, the arms 52 and the signal line conductors 21 of the differential signal transmission cable 20 extend in the same direction toward the cable connector 30. In this state, the arms 52 are electrically connected to the ground contacts 33 of the cable connector 30. Thus, the outer conductors 23 are electrically connected to the ground contacts 33 through the ground conductors 50.

The height h of each of the arms 52 is substantially the same as the diameter d of each of the signal line conductors 21 of the differential signal transmission cable 20 (h≈d). As illustrated in FIG. 6, when the outer conductor 23 is attached to the ground conductor 50, the arms 52 and the signal line conductors 21 are positioned on substantially the same horizontal plane. Thus, the arm 52 and the signal line conductors 21 can simultaneously come into contact with the ground contacts 33 and the signal line contacts 32, respectively (see FIG. 1).

As illustrated in FIG. 5, the clamp mechanism 60 includes a first plate member 61, which is an example of a first clamp member, and a second plate member 62, which is an example of a second clamp member. The plate members 61 and 62 are each made of an insulating material, such as an epoxy resin, so as to have a substantially rectangular shape.

A pair of separation torsion springs 63 (examples of a separation elastic member) are disposed at one end of the plate members 61 and 62 in the longitudinal direction of the plate members 61 and 62 (the left end in FIG. 5). The separation torsion springs 63 each include a coil portion 63*a* and a pair of attachment arms 63*b*. One of the attachment arms 63*b* is fixed to the first plate member 61, and the other attachment arm 63*b* is fixed to the second plate member 62 (see FIG. 6). As indicated by arrows in FIG. 6, the separation torsion springs 63 generate elastic forces F1 in directions such that the plate members 61 and 62 are separated from each other.

The separation torsion springs 63 are provided in a pair so that the plate members 61 and 62 can be separated from each other without being inclined relative to each other. Instead of the pair of separation torsion springs 63, for example, a plate spring having a substantially U-shaped cross section may be used as a separation elastic member. In this case, the plate members 61 and 62 can be separated from each other without being inclined relative to each other by using only one plate spring, because plate-like portions of the plate spring are fixed to the plate members 61 and 62.

An engagement member 64 is disposed at the other end of the plate members 61 and 62 in the longitudinal direction of the plate members 61 and 62 (the right end in FIG. 5). The engagement member 64 includes a first engagement hook 64*a* and a second engagement hook 64*b*, which are integrally formed with the plate members 61 and 62, respectively. The first engagement hook 64*a* extends from the first plate member 61 toward the second plate member 62, and the second engagement hook 64*b* extends from the second plate member 62 toward the first plate member 61.

As illustrated in FIG. 6, the engagement hooks 64*a* and 64*b* become engaged with each other when the other end portions of the plate members 61 and 62 are closed against the elastic forces F1 of the separation torsion spring 63. When the engagement hooks 64*a* and 64*b* are engaged with each other, a constant distance L3 is maintained between the plate members 61 and 62. Due to the elastic forces F1 of the separation torsion springs 63, the engagement hooks 64*a* and 64*b* are strongly engaged with each other. Thus, engagement of the engagement hooks 64*a* and 64*b* does not become loose and the distance between the plate members 61 and 62 does not change (from the constant distance L3).

The separation torsion springs 63 and the engagement member 64, which cooperate with each other as described above, correspond to a distance maintaining mechanism according to the present invention.

A first cushion member 65*a* and a second cushion member 65*b* are respectively affixed to opposing portions of the plate members 61 and 62. The cushion members 65*a* and 65*b* are sheet-like members made of a foamed polyethylene or the like. As illustrated in FIG. 6, the cushion members 65*a* and 65*b* are respectively disposed in a space between the first plate member 61 and the ground conductor 50 and in a space between the second plate member 62 and the ground conductor 50.

The cushion members 65*a* and 65*b* hold the ground conductors 50 by being elastically deformed, so that the cushion members 65*a* and 65*b* can compensate for the differences in the dimensions of the differential signal transmission cables 20, the ground conductors 50, and the clamp mechanism 60 due to manufacturing errors. With the cushion members 65*a* and 65*b*, the plate members 61 and 62 can collectively hold the differential signal transmission cables 20 securely while limiting elastic deformation of the differential signal transmission cables 20 to the minimum.

A first copper tape 66*a* and a second copper tape 66*b*, which are examples of a conducting member, are affixed to opposing portions of the cushion members 65*a* and 65*b*. As illustrated in FIG. 6, the copper tapes 66*a* and 66*b* are respectively disposed in a space between the first cushion member 65*a* and the ground conductor 50 and in a space between the second cushion member 65*b* and the ground conductor 50. The copper tapes 66*a* and 66*b* are thin and flexible. Therefore, the copper tapes 66*a* and 66*b* become deformed as the cushion members 65*a* and 65*b* become elastically deformed. The copper tapes 66*a* and 66*b* are electrically connected to the ground conductors 50 and to the outer conductors 23. Accordingly, resistance to extraneous noise is further increased and electrical characteristics are made more stable.

Figure 7A:
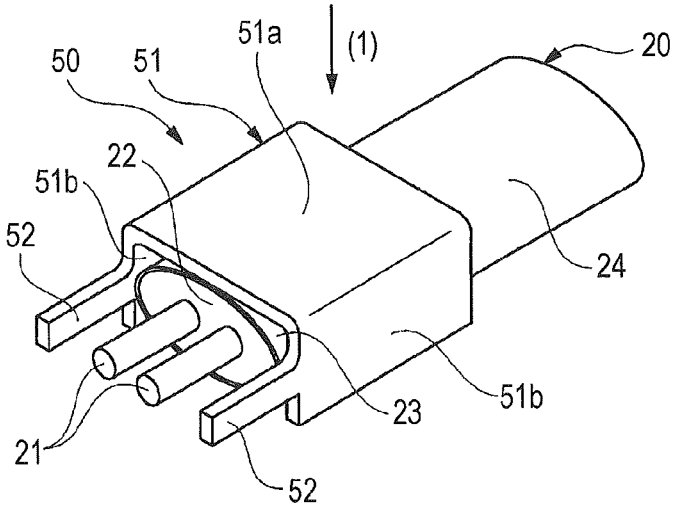
FIGS. 7A and 7B are perspective views illustrating a process of assembling the subassembly shown in FIG. 6.
Figure 7B:
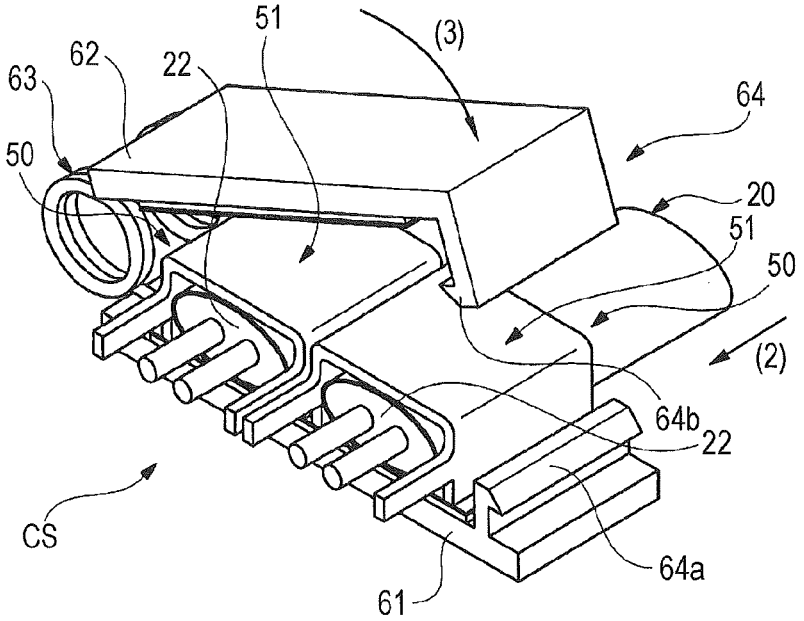

Next, a method of making the cable assembly 10 having the structure described above will be described in detail with reference to the drawings. FIGS. 7A and 7B are perspective views illustrating a process of assembling the subassembly shown in FIG. 6.

Cable Preparation Step

First, two differential signal transmission cables 20 (see FIG. 2), each including the signal line conductors 21, the insulator 22, the outer conductor 23, and the sheath 24 are prepared. As illustrated in FIG. 2, an end of each of the differential signal transmission cables 20 is stripped in a stepwise manner, thereby forming the signal line conductor exposed portion 20*a* and the outer conductor exposed portion 20*b*. Thus, a cable preparation step is finished.

Cable Connector Preparation Step

Next, the cable connector 30, to which the two differential signal transmission cables 20 can be electrically connected, is prepared. The cable connector 30 includes the connector substrate 31, the four signal line contacts 32, and the three ground contacts 33 (see FIG. 3). Thus, a cable connector preparation step is finished.

Cable Connecting Apparatus Preparation Step

The cable connecting apparatus 40, which can collectively hold the two differential signal transmission cables 20, is prepared. The cable connecting apparatus 40 includes the ground conductor 50 (see FIG. 4) and the clamp mechanism 60 (see FIG. 5). Thus, a cable connecting apparatus preparation step is finished.

The differential signal transmission cables 20, the cable connector 30, and the cable connecting apparatus 40 are respectively prepared independently in the cable preparation step, the cable connector preparation step, and the cable connecting apparatus preparation step. Therefore, the order of these steps may be changed.

Cable Subassembly Assembling Step

Next, as indicated by an arrow (1) in FIG. 7A, an open side of the body 51 is directed toward the outer conductor 23, and the body 51 is placed so as to cover the outer conductor 23 from upward along the minor axis of the cross-sectional shape of the differential signal transmission cable 20. At this time, the signal line conductors 21 and the arms 52 are disposed so as to extend in the same direction (leftward in FIG. 7A) and so as to be positioned on the same horizontal plane. Thus, the outer conductor 23 is fitted into a space between the side walls 51*b*, and an operation of attaching the ground conductor 50 to the outer conductor 23 is finished.

Subsequently, as illustrated in FIG. 7B, the ground conductors 50, to which the differential signal transmission cables 20 have been attached, are placed between the first plate member 61 and the second plate member 62 as indicated by an arrow (2) in FIG. 7B so as to be arranged side by side. At this time, the conductors 50 and the cables 20 are disposed in such a way that end surfaces of the plate members 61 and 62 in the transversal direction of the plate members 61 and 62 are flush with end surfaces of the insulators 22 and end surfaces of the bodies 51. Moreover, the ground conductors 50 are arranged side by side in such a way that a predetermined clearance (for example, 1.0 mm) is provided therebetween (see FIG. 6).

After the ground conductors 50, to which the differential signal transmission cables 20 have been attached, have been disposed between the plate members 61 and 62, as indicated by an arrow (3) in FIG. 7B, the plate members 61 and 62 are moved so that ends thereof on the engagement member 64 side approach each other and the first engagement hook 64*a* and the second engagement hook 64*b* become engaged with each other. Thus, the separation torsion springs 63 and the engagement member 64 cooperate with each other to maintain the constant distance L3 between the plate members 61 and 62 (see FIG. 6), and the ground conductors 50 are clamped between the plate members 61 and 62 with the cushion members 65*a* and 65*b* and the copper tapes 66*a* and 66*b* (see FIG. 6) therebetween. Thus, an operation of assembling a cable subassembly CS (see FIG. 6), in which the differential signal transmission cables 20 are held together by the cable connecting apparatus 40, is complete, and a cable subassembly assembling step is finished.

Connection Step

Next, the completed cable subassembly CS is placed so that a side thereof from which the signal line conductors 21 and the arm 52 protrude (the front side of the plane of FIG. 6) faces a side of the cable connector 30 from which the signal line contacts 32 and the ground contacts 33 protrude (the right side in FIG. 3). As illustrated in FIG. 1, each of the signal line conductors 21 is placed on a corresponding one of the signal line contacts 32, and the arms 52 are placed on the ground contacts 33.

Subsequently, laser welding is performed by using a laser welding machine (not shown). By laser welding, spaces between the signal line conductors 21 and the signal line contacts 32 are irradiated with a laser beam so as to weld the signal line conductors 21 to the signal line contacts 32, and spaces between the arms 52 the ground contacts 33 are irradiated with a laser beam so as to weld the arms 52 to the ground contacts 33. Thus, the differential signal transmission cables 20 and the cable connector 30 become electrically connected to each other, and an operation of assembling the cable assembly 10 is complete, and a connection step is finished.

Because laser irradiation is performed only for a short time, heat generated by laser irradiation is not likely to be transferred to the insulators 22 of the differential signal transmission cables 20. Therefore, the insulators 22 do not melt. Welding may be performed by using an ultrasonic welding machine, instead of a laser welding machine.

As described above in detail, the cable assembly 10 according to the first embodiment includes the ground conductors 50, the first plate member 61, the second plate member 62, the separation torsion springs 63, and the engagement member 64. The ground conductors 50 each include the body 51, which is mounted on the outer conductor 23, and the arms 52, which are disposed on the body 51 and connected to the ground contact 33. The first plate member 61 and the second plate member 62 clamp the ground conductors 50 in a state in which the ground conductors 50 are arranged side by side. The separation torsion spring 63 and the engagement member 64 are disposed between the first plate member 61 and the second plate member 62, and maintain the constant distance L3 between the plate members 61 and 62.

Thus, in contrast to existing technologies, it is not necessary to crimp the shield connection terminal so as to follow the shape of the outer conductor 23. Therefore, elastic deformation of the differential signal transmission cables 20 can be suppressed and thereby the electrical characteristics can be stabilized. Moreover, because the plate members 61 and 62 collectively clamp the ground conductors 50 with the same force, that is, under the same conditions, the electrical characteristics of the cable assembly 10 can be stabilized. Furthermore, the cable connecting apparatus 40 holds the differential signal transmission cables 20 while the cable assembly 10 is being assembled. Therefore, the differential signal transmission cables 20 can be easily connected to the cable connector 30.

In the cable assembly 10 according to the first embodiment, the cushion members 65*a* and 65*b* are respectively disposed in a space between the first plate member 61 and the ground conductor 50 and in a space between the second plate member 62 and the ground conductor 50. Thus, the plate members 61 and 62 can collectively hold the differential signal transmission cables 20 securely in a state in which the differences in the dimensions of components due to manufacturing errors are compensated for and elastic deformation of the differential signal transmission cables 20 is limited to the minimum.

In the cable assembly 10 according to the first embodiment, the copper tapes 66*a* and 66*b* are respectively disposed in a space between the cushion members 65*a* and the ground conductor and in a space between the cushion member 65*b* and the ground conductor 50. Therefore, resistance to extraneous noise can be further increased and stability in the electrical characteristics can be further improved.

Next, a second embodiment of the present invention will be described in detail with reference to the drawings. Components of the second embodiment having the same functions as those of the first embodiment will be denoted by the same numerals and detailed descriptions of such components will be omitted.

Figure 8:
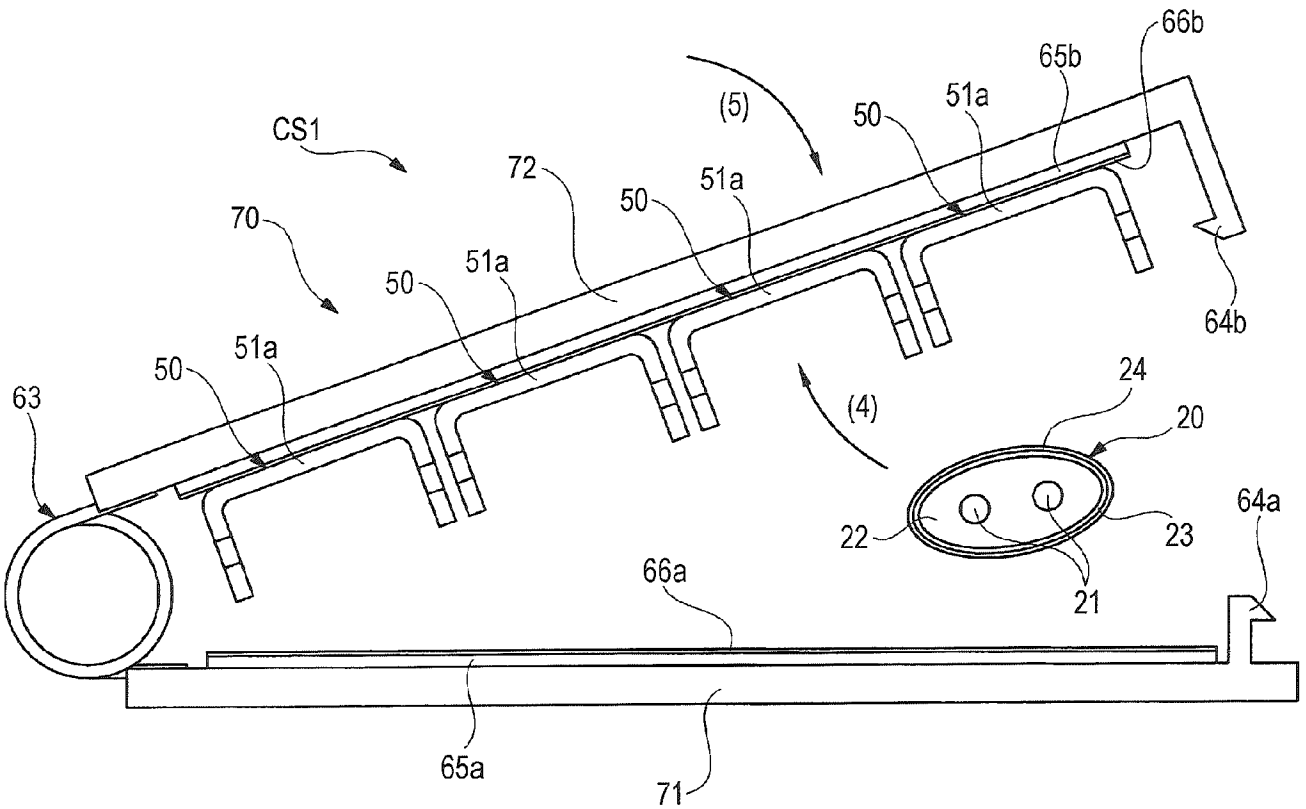
FIG. 8 illustrates a cable connecting apparatus according to a second embodiment.

FIG. 8 illustrates a cable connecting apparatus according to the second embodiment.

As illustrated in FIG. 8, a cable connecting apparatus 70 according to the second embodiment differs from the first embodiment in the following respects. First, the cable connecting apparatus 70 includes a first plate member 71 and a second plate member 72 respectively having lengths that are substantially twice larger than those of the plate members 61 and 62 (see FIG. 6). Second, the top walls 51*a* of four ground conductors 50 are fixed beforehand to a second copper tape 66*b* on the second plate member 72 with predetermined distances therebetween.

As indicated by an arrow (4) in FIG. 8, the outer conductor 23 of each of the differential signal transmission cables 20 is fitted into a corresponding one of the ground conductors 50. Then, as indicated by an arrow (5) in FIG. 8 the plate members 71 and 72 are closed. Thus, an operation of assembling a cable subassembly CS1, in which the four differential signal transmission cables 20 are collectively held, is complete. In accordance with the number of differential signal transmission cables 20, cable connectors of plural types (for connecting four cables, and the like) are prepared and selectively used in accordance with required specifications.

The second embodiment has advantages the same as those of the first embodiment described above. In addition, in the second embodiment, the ground conductors 50 are arranged side by side and fixed to the second plate member 72 with the second copper tape 66*b* therebetween. Therefore, a plurality of (in this case, four) differential signal transmission cables 20 can be securely held between the plate members 71 and 72 with equal distances therebetween.

Next, a third embodiment of the present invention will be described in detail with reference to the drawings. Components of the third embodiment having the same functions as those of the first embodiment will be denoted by the same numerals and detailed descriptions of such components will be omitted.

Figure 9A:
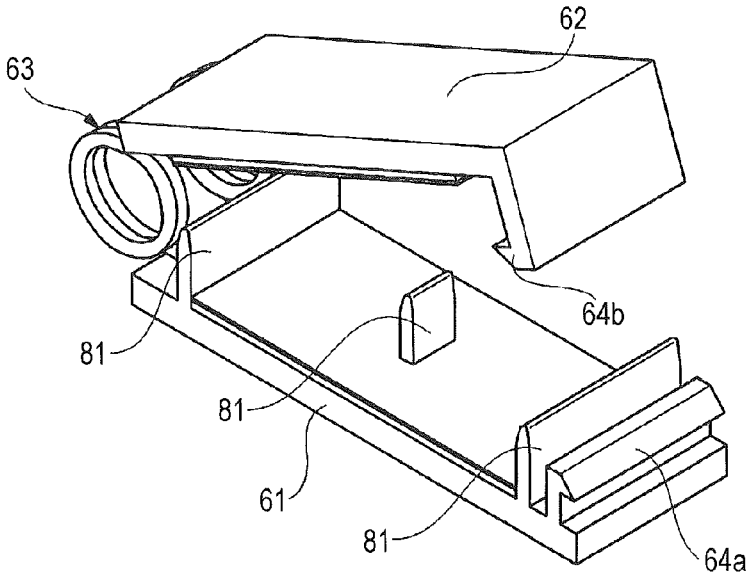
FIGS. 9A and 9B illustrate a cable connecting apparatus according to a third embodiment.
Figure 9B:
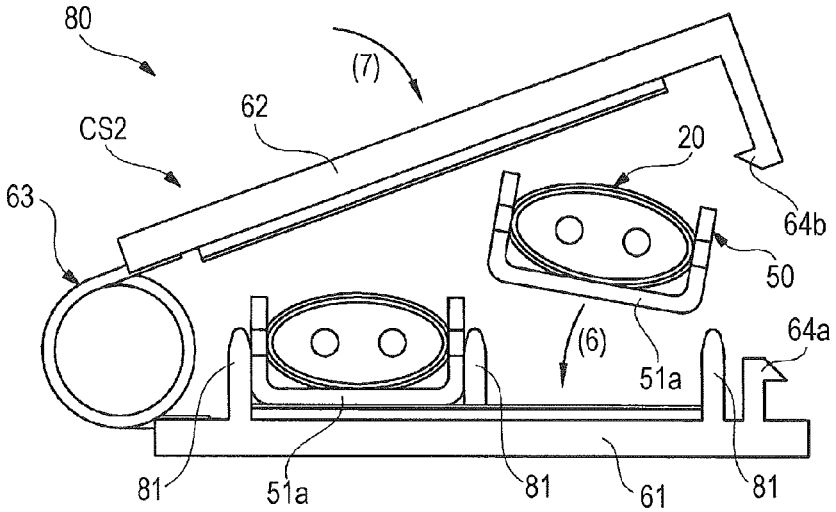

FIGS. 9A and 9B illustrate a cable connecting apparatus according to the third embodiment.

As illustrated in FIGS. 9A and 9B, a cable connecting apparatus 80 according to the third embodiment differs from the first embodiment in the following respects. First, three guide protrusions 81 are provided on a surface of first plate member 61 facing the second plate member 62. Second, the ground conductors 50 are disposed in such a way that the top walls 51*a* of the ground conductors 50 face the first plate member 61.

The distance between the guide protrusions 81 is determined so that the ground conductors 50 can be fitted into spaces between the guide protrusions 81. Ends of the guide protrusions 81 are tapered so that the ground conductors 50 can be easily fitted into the spaces between the guide protrusions 81. As illustrated in FIG. 9A, one of the guide protrusions 81 that is positioned at the center of the guide protrusions 81 has a length smaller than that of other guide protrusions 81 in order to reduce a resistance force generated when the ground conductors 50 are fitted into the spaces between the guide protrusions 81.

As indicated by an arrow (6) in FIG. 9B, the ground conductors 50 are successively fitted into the spaces between the guide protrusions 81. Subsequently, as indicated by an arrow (7) in FIG. 9B, the plate members 61 and 62 are closed. Thus, an operation of assembling a cable subassembly CS2, in which the two differential signal transmission cables 20 are collectively held, is complete.

The third embodiment has advantages the same as those of the first embodiment described above. In addition, in the third embodiment, the guide protrusions 81 for positioning the ground conductors 50 are provided on the first plate member 61. Therefore, the ground conductors 50, to which the differential signal transmission cables 20 are attached, can be reliably arranged with equal distances therebetween.

Next, a fourth embodiment of the present invention will be described in detail with reference to the drawings. Components of the fourth embodiment having the same functions as those of the first embodiment will be denoted by the same numerals and detailed descriptions of such components will be omitted.

Figure 10A:
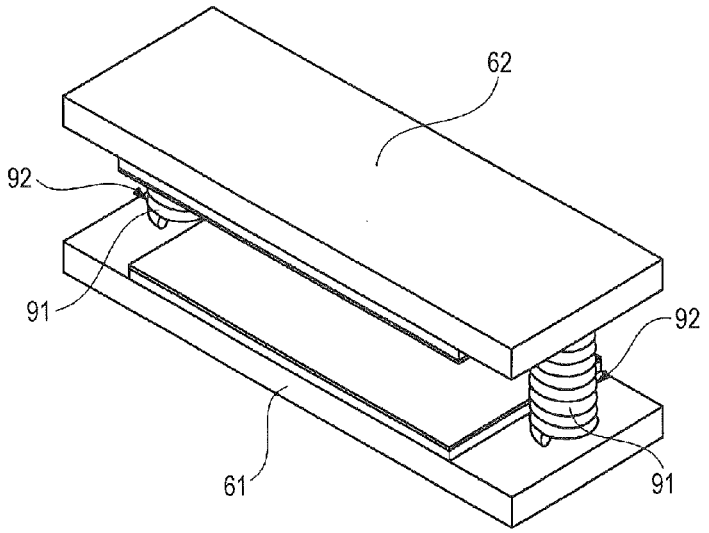
FIGS. 10A and 10B illustrate a cable connecting apparatus according to a fourth embodiment.
Figure 10B:
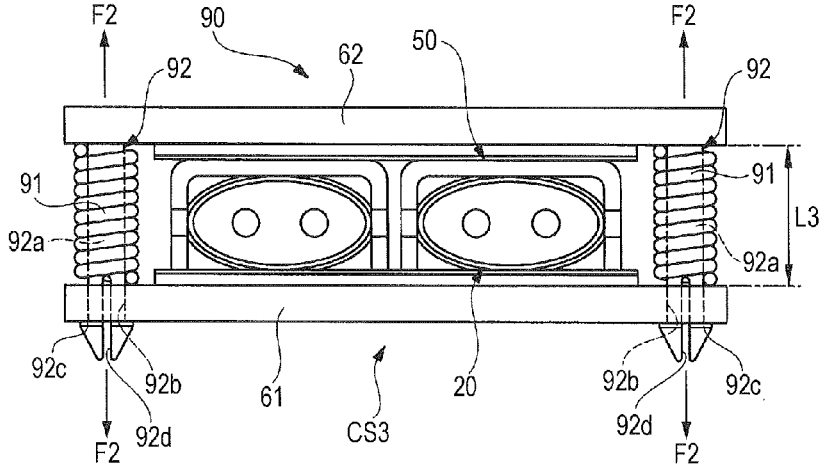

FIGS. 10A and 10B illustrate a cable connecting apparatus according to the fourth embodiment.

As illustrated in FIGS. 10A and 10B, a cable connecting apparatus 90 according to the fourth embodiment differs from the first embodiment in the structure of a distance maintaining mechanism disposed between the plate members 61 and 62. To be specific, in the first embodiment, the distance maintaining mechanism includes the separation torsion spring 63 and the engagement member 64 (see FIG. 5). In the fourth embodiment, the distance maintaining mechanism includes a pair of separation coil springs 91 and engagement members 92 disposed inside the separation coil springs 91.

The separation coil springs 91 (examples of a separation elastic member) are disposed at both ends of the plate members 61 and 62 in the longitudinal direction of the plate members 61 and 62. The separation coil springs 91 each generate elastic forces F2 in directions such that the plate members 61 and 62 are separated from each other. Accordingly, with the fourth embodiment, the elastic forces F2 can be applied to both ends of the plate members 61 and 62 in the longitudinal direction in a well-balanced manner.

The engagement members 92 each include a bar-like protrusion 92*a* and a through-hole 92*b*. The bar-like protrusion 92*a* is integrally formed with the second plate member 62 so as to protrude toward the first plate member 61. The through-hole 92*b* is formed in the first plate member 61. The bar-like protrusion 92*a* is slidably inserted into the through-hole 92*b*. A head 92*c* and a cutout 92*d* are formed at one end of the bar-like protrusion 92*a* on the through-hole 92*b* side. The head 92*c* has a diameter that is slightly larger than that of the diameter of the through-hole 92*b*. The cutout 92*d* extends from the head 92*c* toward the plate member 62 in the longitudinal direction of the bar-like protrusion 92*a*.

Thus, by compressing the heads 92*c*, the heads 92*c* can be inserted into the through-holes 92*b*. After having been inserted, the heads 92*c* engage with the through-holes 92*b*. In a state in which the heads 92*c* are engaged with the through-holes 92*b*, the distance between the plate members 61 and 62 is the constant distance L3, as in the first embodiment.

The ground conductors 50, to which the differential signal transmission cables 20 have been attached, can be clamped between the plate members 61 and 62 as illustrated in FIG. 10B through the following process. First, one of the two engagement members 92 is disengaged. Then, the plate members 61 and 62 are rotated relative to each other around the other engagement member 92, and the ground conductors 50, to which the differential signal transmission cables 20 have been attached, are placed between the plate members 61 and 62. Subsequently, the one of the engagement members 92 is engaged by performing an operation opposite that of disengaging the engagement member 92. Thus, an operation of assembling a cable subassembly CS3, in which the two differential signal transmission cables 20 are collectively held, is complete.

The fourth embodiment has advantages the same as those of the first embodiment described above. In addition, with the fourth embodiment, the separation coil springs 91 apply the elastic forces F2 to both ends of the plate members 61 and 62 in the longitudinal direction of the plate members 61 and 62 in a well-balanced manner. Therefore, the plate members 61 and 62 can collectively hold the ground conductors 50 with the same force, that is, under the same conditions.

Next, a fifth embodiment of the present invention will be described in detail with reference to the drawings. Components of the fifth embodiment having the same functions as those of the first embodiment will be denoted by the same numerals and detailed descriptions of such components will be omitted.

Figure 11:
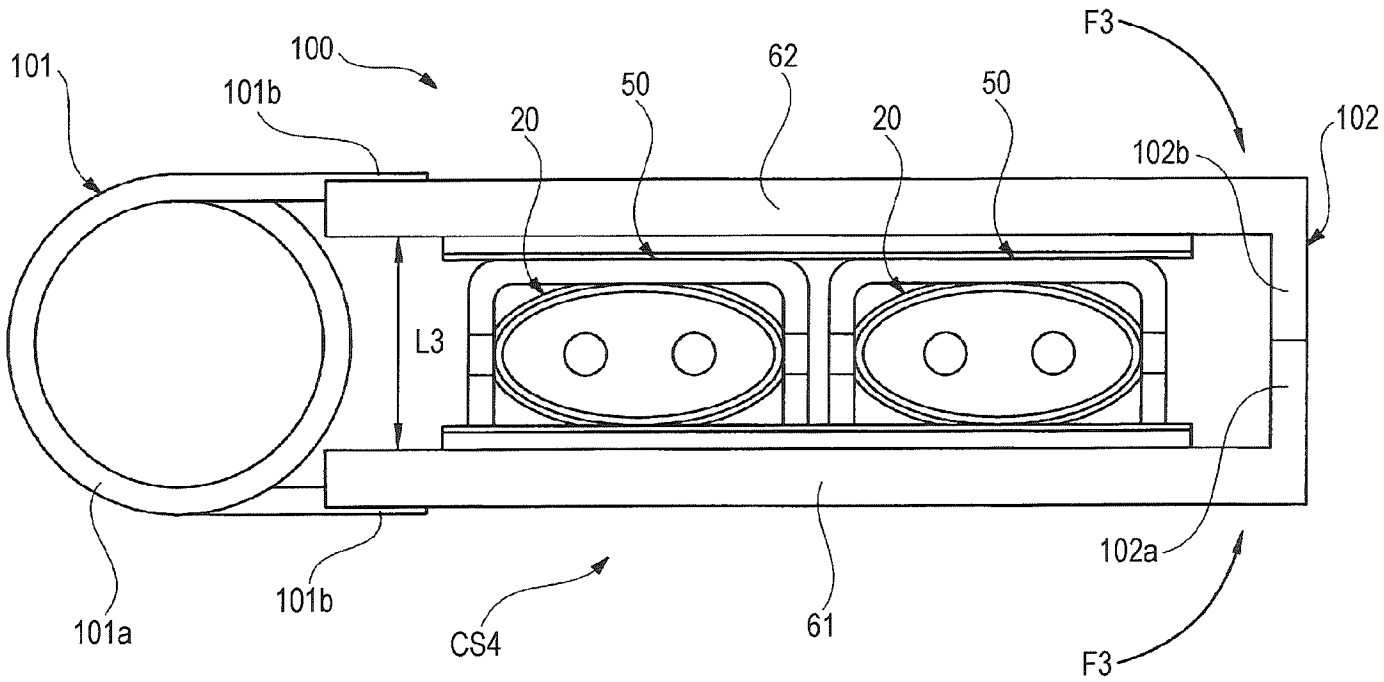
FIG. 11 illustrates a cable connecting apparatus according to a fifth embodiment.

FIG. 11 illustrates a cable connecting apparatus according to the fifth embodiment.

As illustrated in FIG. 11, a cable connecting apparatus 100 according to the fifth embodiment differs from the first embodiment in the structure of a distance maintaining mechanism disposed between the plate members 61 and 62. To be specific, in the first embodiment, the distance maintaining mechanism includes the separation torsion spring 63 and the engagement member 64 (see FIG. 5). In the fifth embodiment, the distance maintaining mechanism includes a pair of approach torsion springs 101 (on of which is shown in FIG. 11) and a contact member 102.

The approach torsion springs 101 (examples of an approach elastic member) generate elastic forces F3 in directions such that the plate members 61 and 62 are made to approach each other. The approach torsion springs 101 each include a coil portion 101*a* and a pair of attachment arms 101*b*. The attachment arm 101*b* are fixed to outer sides of the plate members 61 and 62, that is, to the sides on which the differential signal transmission cables 20 are not disposed. Thus, the approach torsion springs 101 are not easily removed from the plate members 61 and 62 due to their own elastic forces F3.

The contact member 102 includes a first protrusion 102*a* and a second protrusion 102*b*. The first protrusion 102*a* is formed on the first plate member 61 and protrudes toward the second plate member 62. The second protrusion 102*b* is formed on the second plate member 62 and protrudes toward the first plate member 61. The protrusions 102*a* and 102*b* are configured to face each other and contact each other. The sum of the heights of the protrusions 102*a* and 102*b* in the protruding direction is equal to L3. Thus, when the plate members 61 and 62 approach each other due to the elastic forces F3 of the approach torsion springs 101, the protrusions 102*a* and 102*b* are brought into contact with each other, and thereby the constant distance L3 is maintained between the plate members 61 and 62.

The ground conductors 50, to which the differential signal transmission cables 20 have been attached, can be clamped between the plate members 61 and 62 as illustrated in FIG. 11 through the following process. First, ends of the plate members 61 and 62 on the contact member 102 side are opened against the elastic forces F3 of the torsion springs 101. In this state, the ground conductors 50, to which the differential signal transmission cables 20 have been attached, are placed between the plate members 61 and 62. Subsequently, the ends of the plate members 61 and 62 on the contact member 102 side are closed, so that the protrusions 102*a* and 102*b* approach each other and come into contact each other. Thus, an operation of assembling a cable subassembly CS4, in which the two differential signal transmission cables 20 are collectively held, is complete.

The fifth embodiment has advantages the same as those of the first embodiment described above. In addition, the fifth embodiment has a simpler structure, because the contact member 102 does not have lugs as those of the engagement member 64 of the first embodiment.

The present invention is not limited to the embodiments described above and may be modified in various ways within the spirit and scope of the present invention. For example, in the embodiments described above, the cushion members 65*a* and 65*b* and the copper tapes 66*a* and 66*b* are respectively provided on the plate members 61 and 62 or on the plate members 71 and 72. However, the present invention is not limited to this, and one of the cushion members or one of the copper tapes may be omitted. In this case, the thicknesses of the cable connecting apparatuses 40, 70, 80, 90, and 100 are reduced and the apparatuses can be made compact.

In the embodiments described above, the cable connecting apparatuses 40, 70, 80, 90, and 100 can collectively hold two or four differential signal transmission cables 20. However, the present invention is not limited to these and can be used to connect, for example, three, five, or more differential signal transmission cables 20.

What is claimed is:

1. A cable connecting apparatus for collectively connecting a plurality of differential signal transmission cables to a cable connector, the plurality of differential signal transmission cables each including a pair of signal line conductors, an insulator surrounding the pair of signal line conductors, and an outer conductor surrounding the insulator, the cable connector including a pair of signal line contacts corresponding to the pair of signal line conductors and a ground contact corresponding to the outer conductor, the cable connecting apparatus comprising:

a plurality of ground conductors each including a body that is to be mounted on the outer conductor and an arm that is disposed on the body and to be connected to the ground contact;

a first clamp member and a second clamp member that clamp the ground conductors in a state in which the ground conductors are arranged side by side; and a distance maintaining mechanism that is disposed between the first clamp member and the second clamp member and that maintains a constant distance between the clamp members;

wherein the distance maintaining mechanism includes a separation elastic member that is disposed between the clamp members and that generates an elastic force in a direction such that the clamp members are separated from each other, and engagement members that are disposed between the clamp members and that maintain a constant distance between the clamp members by being engaged with each other.

2. The cable connecting apparatus according to claim 1, further comprising:

a cushion member disposed in at least one of a space between the first clamp member and the ground conductors and a space between the second clamp member and the ground conductors.

3. The cable connecting apparatus according to claim 2, further comprising:

a conducting member disposed between the cushion member and the ground conductors.

4. The cable connecting apparatus according to claim 1, wherein the ground conductors are arranged side by side and fixed to at least one of the clamp members.

5. The cable connecting apparatus according to claim 1, further comprising:

a guide protrusion that is disposed on at least one of the clamp members and that positions the ground conductors.

6. A cable assembly comprising:

a plurality of differential signal transmission cables each including a pair of signal line conductors, an insulator surrounding the pair of signal line conductors, and an outer conductor surrounding the insulator;

a cable connector to which the plurality of differential signal transmission cables are connected, the cable connector including a connector substrate made of an insulating material, a pair of signal line contacts disposed on the connector substrate and corresponding to the pair of signal line conductors, and a ground contact disposed on the connector substrate and corresponding to the outer conductor; and a cable connecting apparatus that collectively connects the plurality of differential signal transmission cables to the cable connector, the cable connecting apparatus including a plurality of ground conductors each including a body that is mounted on the outer conductor and an arm that is disposed on the body and connected to the ground contact, a first clamp member and a second clamp member that clamp the ground conductors in a state in which the ground conductors are arranged side by side, and a distance maintaining mechanism that is disposed between the first clamp member and the second clamp member and that maintains a constant distance between the clamp members;

wherein the distance maintaining mechanism includes a separation elastic member that is disposed between the clamp members and that generates an elastic force in a direction such that the clamp members are separated from each other, and engagement members that are disposed between the clamp members and that maintain a constant distance between the clamp members by being engaged with each other.

7. The cable assembly according to claim 6, wherein the cable connecting apparatus further includes a cushion member disposed in at least one of a space between the first clamp member and the ground conductors and a space between the second clamp member and the ground conductors.

8. The cable assembly according to claim 7, wherein the cable connecting apparatus further includes a conducting member disposed between the cushion member and the ground conductors.

9. The cable assembly according to claim 6, wherein the ground conductors are arranged side by side and fixed to at least one of the clamp members.

10. The cable assembly according to claim 6, wherein the cable connecting apparatus further includes a guide protrusion that is disposed on at least one of the clamp members and that positions the ground conductors.

11. A method of making a cable assembly, the method comprising:

a cable preparation step of preparing a plurality of differential signal transmission cables each including a pair of signal line conductors, an insulator surrounding the pair of signal line conductors, and an outer conductor surrounding the insulator;

a cable connector preparation step of preparing a cable connector including a connector substrate made of an insulating material, a pair of signal line contacts disposed on the connector substrate and corresponding to the pair of signal line conductors, and a ground contact disposed on the connector substrate and corresponding to the outer conductor;

a cable connecting apparatus preparation step of preparing a cable connecting apparatus including a plurality of ground conductors each including a body that is to be mounted on the outer conductor and an arm that is disposed on the body and to be connected to the ground contact, a first clamp member and a second clamp member that clamp the ground conductors in a state in which the ground conductors are arranged side by side, and a distance maintaining mechanism that is disposed between the first clamp member and the second clamp member and that maintains a constant distance between the clamp members;

a cable subassembly assembling step of mounting the bodies of the ground conductors on the outer conductors, arranging the ground conductors, to which the differential signal transmission cables have been attached, side by side between the first clamp member and the second clamp member, and causing the clamp members to clamp the ground conductors while causing the distance maintaining mechanism to maintain a constant distance between the clamp members; and a connection step of disposing the signal line conductors on the signal line contacts, disposing the arms on the ground contacts, welding the signal line conductors to the signal line contacts, and welding the arms to the ground contacts;

wherein the distance maintaining mechanism includes a separation elastic member that is disposed between the clamp members and that generates an elastic force in a direction such that the clamp members are separated from each other, and engagement members that are disposed between the clamp members and that maintain a constant distance between the clamp members by being engaged with each other.

* * * * *